US009449769B2

(12) United States Patent
Leong et al.

(10) Patent No.: US 9,449,769 B2
(45) Date of Patent: Sep. 20, 2016

(54) LOW TRAVEL DOME AND SYSTEMS FOR USING THE SAME

(71) Applicant: Apple Inc., Cupertino, CA (US)

(72) Inventors: Craig C. Leong, San Jose, CA (US); James J. Niu, San Jose, CA (US); John M. Brock, San Francisco, CA (US); Keith J. Hendren, San Francisco, CA (US); Thomas W. Wilson, Jr., Saratoga, CA (US)

(73) Assignee: APPLE INC., Cupertino, CA (US)

( * ) Notice: Subject to any disclaimer, the term of this patent is extended or adjusted under 35 U.S.C. 154(b) by 275 days.

(21) Appl. No.: 14/066,197

(22) Filed: Oct. 29, 2013

(65) Prior Publication Data

US 2014/0116867 A1 May 1, 2014

Related U.S. Application Data

(60) Provisional application No. 61/720,372, filed on Oct. 30, 2012.

(51) Int. Cl.
*H01H 13/14* (2006.01)
*H01H 13/85* (2006.01)

(52) U.S. Cl.
CPC ..... *H01H 13/14* (2013.01); *H01H 13/85* (2013.01); *H01H 2215/006* (2013.01); *H01H 2215/02* (2013.01)

(58) Field of Classification Search
CPC ..... H01H 13/14; H01H 2215/02; H01H 2215/006; H01H 13/85
USPC ..... 200/512–514, 5 A, 521, 341
See application file for complete search history.

(56) References Cited

U.S. PATENT DOCUMENTS 4,354,068 A * 10/1982 Sobol, III ..... H01H 13/705 200/292
4,634,818 A * 1/1987 Hayes-Pankhurst . H01H 13/702 200/5 A
5,340,955 A * 8/1994 Calvillo ..... H01H 13/063 200/302.2
5,389,757 A * 2/1995 Souliere ..... H01H 13/705 200/345
5,559,311 A * 9/1996 Gorbatoff ..... H01H 13/70 200/1 B
6,246,019 B1 * 6/2001 Nakamura ..... H01H 13/702 200/5 R
6,344,791 B1 * 2/2002 Armstrong ..... A63F 13/06 338/114
8,431,852 B2 * 4/2013 Maruyama ..... H01H 3/122 200/302.2

* cited by examiner

*Primary Examiner* — Edwin A. Leon
(74) *Attorney, Agent, or Firm* — Brownstein Hyatt Farber Schreck, LLP

(57) ABSTRACT

A low travel switch and systems for using the same. A low travel switch may include a key cap and an elastomeric dome configured to provide a predefined tactile feedback over a predefined travel distance of the key cap when the key cap is depressed by a user.

36 Claims, 7 Drawing Sheets

LOW TRAVEL DOME AND SYSTEMS FOR USING THE SAME

CROSS-REFERENCE TO RELATED APPLICATIONS

This application claims priority to and the benefit of U.S. Provisional Patent Application No. 61/720,372, filed Oct. 30, 2012 and titled "Low Travel Dome and Systems for Using the Same," the disclosure of which is hereby incorporated herein in its entirety.

TECHNICAL FIELD

This can relate to a low travel dome and systems for using the same.

BACKGROUND

Many electronic devices (e.g., desktop computers, laptop computers, mobile devices, and the like) include a keyboard as one of its input devices. There are several types of keyboards that are typically included in electronic devices. Each of these types is mainly differentiated by the switch technology employed. One of the most common keyboard types is the dome-switch keyboard. In an elastomeric dome-switch keyboard, for example, each key of the keyboard resides over a corresponding elastomeric (e.g., rubber) dome that may be a discrete component or part of an elastomeric pad. The elastomeric dome resides over a membrane that is sectioned into regions that each corresponds to a respective key and elastomeric dome. When a user depresses a particular key, the key moves downward from an initial position and displaces its corresponding elastomeric dome. As a result, the elastomeric dome buckles or collapses, which provides tactile feedback to the user. Moreover, when the elastomeric dome buckles, the elastomeric dome presses onto a corresponding region of the membrane and causes opposite facing electrical pads of that region to contact one another. This contact is detected by a processing unit (e.g., a chip), which generates a code corresponding to the key that is depressed. The key can move downward until it reaches a maximum displacement from its initial position. The total displacement from the initial position to the maximum displacement is referred to as the travel of the key.

It is often desirable to make devices, such as electronic devices and keyboards, lighter and smaller. For devices that include a dome-switch keyboard, one of the ways to achieve this is to decrease the amount of travel of the keys of the keyboard. However, a decrease in the travel of a key can affect the level of tactile feedback that the key provides to a user.

SUMMARY

A low travel dome and systems for using the same are provided.

In some embodiments, an elastomeric dome for use with a key is provided that includes a lower portion, an upper portion, and a wall that spans from the lower portion to the upper portion. Each of the wall, the lower portion, and the upper portion includes a physical property. The elastomeric dome is tuned to provide predefined tactile feedback over a predetermined travel amount of the key based on a predefined ratio between one of the physical properties and another one of the physical properties.

In some embodiments, an elastomeric dome for use with a key in a keyboard is provided. The elastomeric dome includes a footprint, a roof portion having a predetermined diameter, and a wall of a predetermined thickness that connects the roof portion to the footprint. A ratio between the predetermined thickness and the predetermined diameter is less than 10%. The elastomeric dome is operative to enable a keystroke of the key to undergo an abrupt force change when the keystroke is 1.25 millimeters or less.

In some embodiments a switch assembly is provided that includes a key cap, a hemispherical structure residing beneath the key cap and including an upper portion, a lower portion, and a domed surface extending from the upper portion to the lower portion. The domed surface has a predefined thickness, and the lower portion has an outer diameter. A ratio between the predetermined thickness and the outer diameter is one of less than and equal to 4%. The hemispherical structure is operative control movement of the key cap according to a predetermined force-displacement curve characteristic when the movement is less than a predetermined amount.

In some embodiments, an apparatus for use with a key of a keyboard is provided. The apparatus includes an inner dome at least partially surrounded by an outer dome. The inner dome has a first opening that faces a first direction, and the outer dome has a second opening that faces a direction opposite the first direction.

BRIEF DESCRIPTION OF THE DRAWINGS

The above and other aspects and advantages of the invention will become more apparent upon consideration of the following detailed description, taken in conjunction with accompanying drawings, in which like reference characters refer to like parts throughout, and in which.

DETAILED DESCRIPTION

A low travel dome and systems for using the same are described with reference to FIGS. 1-10.

Figure 1:
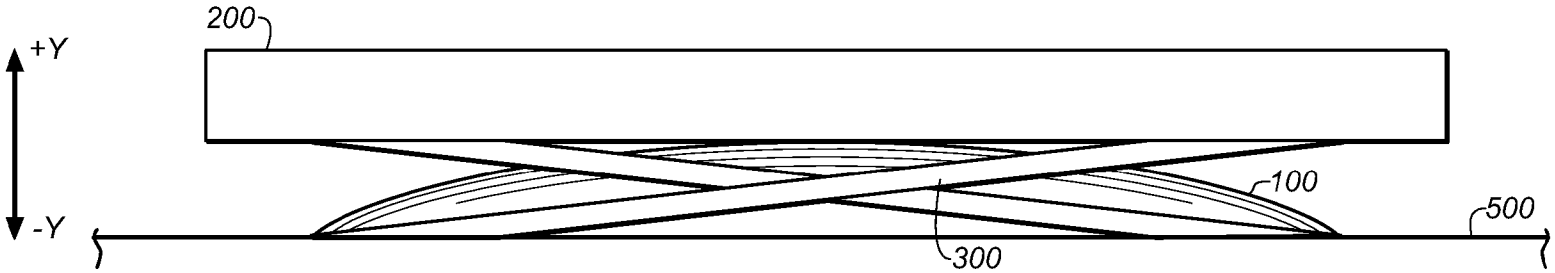
FIG. 1 is a cross-sectional view of a switch assembly that includes a low travel elastomeric dome, a key cap, a support structure, and a membrane, in accordance with at least one embodiment.

FIG. 1 is a cross-sectional view of a switch assembly that includes a low travel elastomeric dome 100, a key cap 200, a support structure 300, and a membrane 500. Elastomeric dome 100 may be composed of any suitable type of material (e.g., plastic, rubber, metal, silicone, etc.), and may have a predefined durometer value. When a force is applied to elastomeric dome 100, its elasticity may cause it to return to its original shape when the force is subsequently released. In some embodiments, elastomeric dome 100 may be one of a plurality of domes that may be a part of a dome pad or sheet (not shown). For example, elastomeric dome 100 may protrude from such a dome sheet in the positive Y-direction. This dome sheet may reside beneath a set of key caps (e.g., key cap 200) of a keyboard (not shown) such that each dome of the dome pad may reside beneath a particular key cap of the keyboard. In other embodiments, elastomeric dome 100 may be manufactured from and cut out from such a dome sheet as a discrete component.

As shown in FIG. 1, for example, elastomeric dome 100 may reside beneath key cap 200. Key cap 200 may be supported by support structure 300. Support structure 300 may be composed of any suitable material (e.g., plastic, metal, composite, etc.), and may provide mechanical stability to key cap 200. Support structure 300 may, for example, be a scissor mechanism or a butterfly mechanism that may contract and expand during depression and release of key cap 200, respectively. In some embodiments, rather than being a standalone scissor or butterfly mechanism, support structure 300 may be a part of an underside of key cap 200 that may press onto various portions of elastomeric dome 100. Regardless of the physical nature of support structure 300, key cap 200 may press onto elastomeric dome 100 to effect a switching operation or event via membrane 500 (described in more detail below with respect to FIGS. 5-8). Although not shown in FIG. 1, key cap 200 may also include a lower end portion that may be configured to contact an uppermost portion of elastomeric dome 100 during depression of key cap 200.

FIG. 1 may show key cap 200, elastomeric dome 100, support structure 300, and membrane 500 in an underpressed state (e.g., where each component may be in its respective natural position, prior to key cap 200 being depressed). Although FIG. 1 does not show key cap 200, elastomeric dome 100, support structure 300, and membrane 500 in a partially depressed or a fully depressed state, it should be appreciated that these components may occupy any of these states.

In addition to facilitating a switching event when a key cap is depressed, a dome of a dome-switch may also serve other purposes. As an example, the dome may cause the key cap to return to its natural state or position after the key cap is released from depression. As another example, the dome may provide tactical feedback to a user when the user depresses the key cap. The physical attributes (e.g., elasticity, size, shape, etc.) of the dome may determine the level of tactical feedback it provides. In particular, the physical attributes may define a relationship between the amount of force required to move the key cap (e.g., when the key cap rests over the dome) over a range of distances. This relationship may be expressed by a force-displacement curve, and the dome may operate according to this curve.

The amount of force required to move the key cap may vary depending on how far the key cap has moved from its natural position, and a user may experience the tactile feedback as a result of this variance. For example, the force required to move an uppermost portion of the dome from its natural or initial position to a first distance (e.g., right up to the point before the dome collapses or buckles) may be a force F1.

The force required to continue to move the uppermost portion past this first distance may be less than force F1. This is because the dome may buckle or collapse when the uppermost portion moves past the first distance, which may lessen the force required to continue to move the uppermost portion.

The force required to move the uppermost portion to a point when the dome is just completely buckled or collapsed may be a force F2. The force required to continue to move the uppermost portion until the key cap reaches its farthest or most depressed point may then increase. A user may thus experience a certain tactile feedback due to the force-displacement characteristics of the dome.

It should be appreciated that the tactile feedback can be quantified when the force-displacement characteristics of a dome are known. More particularly, the tactile feedback is a function of the click ratio (F1−F2)/F1, where F1 is the force required to move the uppermost portion of the dome from its natural position to a distance right before the dome begins to buckle or collapse and F2 is the force required to move the uppermost portion from its natural position to a distance when the dome is just completely buckled or collapsed.

Because a dome's tactile feedback is tied to the force-displacement characteristics of the dome, it should also be appreciated that force-displacement characteristics of a dome can be determined when an optimal or suitable tactile feedback is predefined. For example, a dome may provide optimal tactile feedback when a click ratio is about 50%. This click ratio may be used to determine force-displacement characteristics (e.g., force F1 and force F2) required to provide the optimal tactile feedback. Accordingly, because the physical attributes of the dome correspond to the force-displacement characteristics, the dome may be specifically constructed in order to meet these characteristics.

As described above, it is often desirable to make electronic devices and keyboards smaller. To accomplish this, some components of a device may need to be made smaller. Moreover, certain movable components of the device may also have less space to move, which may make it difficult for them to perform their intended functions. For example, the travel of the key caps of a keyboard will have to be smaller. However, a smaller travel requires a smaller or restricted range of movement of a corresponding dome, which may interfere with the dome's ability to operate according to its intended force-displacement characteristics and to provide suitable tactile feedback to a user.

Since the physical attributes of the dome are associated with the dome's tactile feedback, they may be adjusted, modified, or manipulated, or otherwise tuned to compensate for the smaller travel, while also providing the predefined optimal tactile feedback.

Certain physical attributes of a dome may be adjusted, modified, manipulated, or otherwise tuned to compensate for a specified travel, while also providing predefined tactile feedback. That is, certain physical attributes of a dome may be tuned such that the dome operates according to predetermined force-displacement curve characteristics. In some embodiments, the height, thickness, diameter, and various other dimensions of the dome may be tuned. In some embodiments, the dome may be tuned by determining ratios between certain dimensions (e.g., height, thickness, diameter, angle, etc.) of the dome that may allow the dome to operate according to the predetermined force-displacement curve characteristics.

Figure 2:
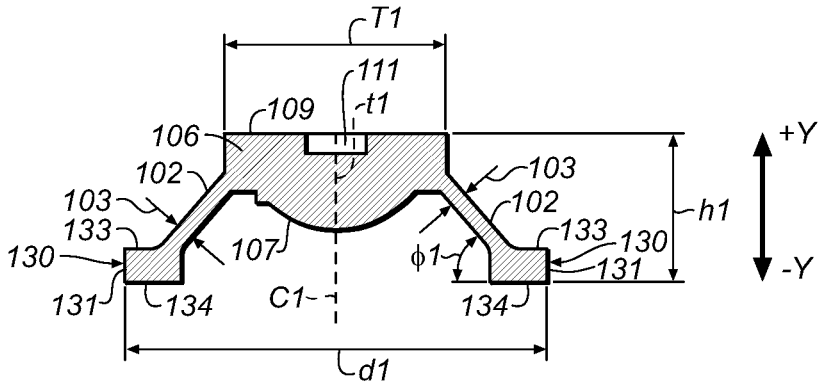
FIG. 2 is a cross-sectional view of the elastomeric dome of FIG. 1, in accordance with at least one embodiment.

FIG. 2 is a cross-sectional view of elastomeric dome 100. Elastomeric dome 100 is axis-symmetric, therefore the right and left halves of dome 100 are mirror images of each other. Dome has footprint 130 defined by foot portion 131. Foot portion 131 is coupled to roof portion 106 by wall 102, which has thickness 103. Wall 102 is a contiguous surface that may, for example, be hemispherically-shaped or domed-shaped, and may form a hollow cavity within.

Roof portion 106 may include a nub or contact surface 107, a top surface 109, and a recess 111 nestled within roof portion 106. A key cap (e.g., key cap 200 of FIG. 1) may reside over top surface 109 and recess 111. When an external force is applied (e.g., via key cap 200) to any one of top surface 109 and recess 111, roof portion 106 may move in the negative Y-direction, and may cause wall 102 and 104 (and thus, the contiguous wall) to change shape and buckle. When roof portion moves a sufficient distance in the negative Y-direction, contact surface 107 may contact a portion of a membrane of a keyboard (e.g., described below with respect to FIG. 5) to trigger a switch event.

Figure 3:
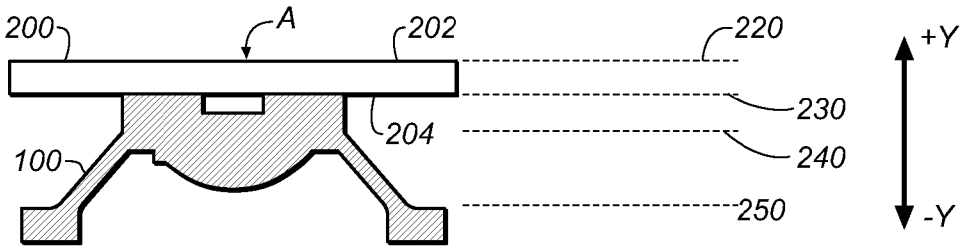
FIG. 3 is a cross-sectional view of a switch assembly including the elastomeric dome of FIG. 2 and the key cap of FIG. 1, in accordance with at least one embodiment.

FIG. 3 is a cross-sectional view of a switch assembly including elastomeric dome 100 and key cap 200. FIG. 3 may be similar to FIG. 1, but does not show support structure 300. In some embodiments, support structure 300 may not be necessary, and a switching assembly can include key cap 200, elastomeric dome 100, and membrane 500 (discussed below in more detail in connection FIG. 5). Key cap 200 may include a cap surface 202 and an underside 204. Underside 204 may reside over top surface 109 of roof portion 106. When an external force A is applied (e.g., by a user) onto cap surface 204 in the negative Y-direction, the force may cause roof portion 106 to move in the negative Y-direction. Although not shown in FIG. 3, in some embodiments, key cap 200 may also include one or more protruding portions that may protrude from underside 204 in the negative Y-direction, and that may press onto any suitable portion elastomeric dome 100.

Figure 4:
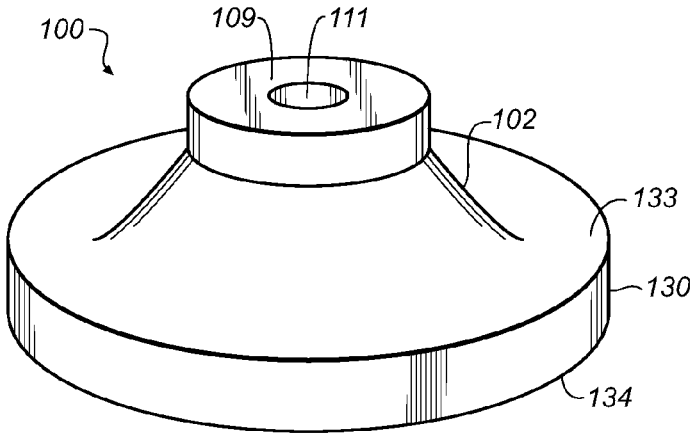
FIG. 4 is a perspective view of the elastomeric dome of FIG. 2, in accordance with at least one embodiment.

FIG. 4 is a perspective view of elastomeric dome 100 of FIG. 2. As shown in FIG. 4, wall 102 extends from top surface 109 to top surface 133 of footprint 130. As shown here, wall 102 exhibits a conically-shaped wall.

Figure 5:
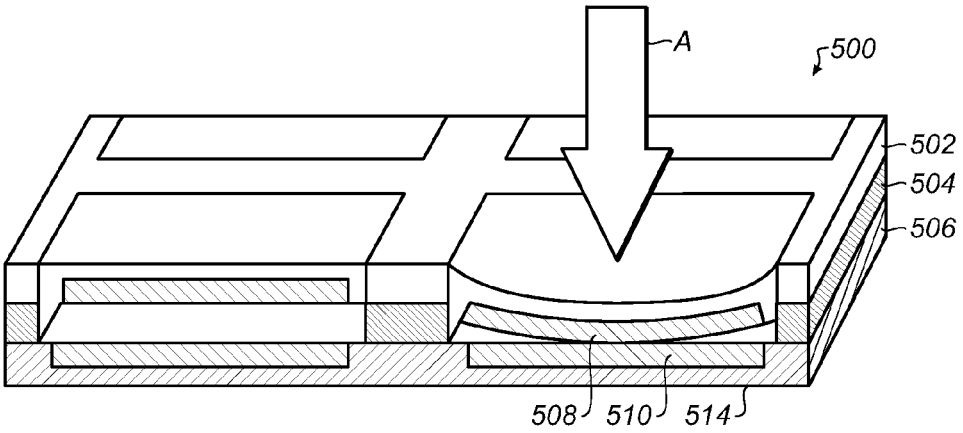
FIG. 5 is a perspective view of a three-layer membrane of a PCB that may interact with the elastomeric dome of FIG. 2, in accordance with at least one embodiment.

FIG. 5 is a perspective view of a three-layer membrane 500 of a printed circuit board ("PCB") that may interact with elastomeric dome 100. As described above with respect to FIG. 2, elastomeric dome 100 may be a component of a keyboard (not shown). In some embodiments, the keyboard may include a PCB and membrane that may provide key switching (e.g., when key cap 200 is depressed in the negative Y-direction via an external force A). As shown in FIG. 5, membrane 500 may reside beneath elastomeric dome 100. Membrane 500 may include a top layer 502, a bottom layer 506, and a spacer layer 504 that may reside between top layer 502 and bottom layer 506. In some embodiments, top layer 502 and bottom layer 506 may each have a thickness in the Y-direction of about 0.075 micrometers, and spacer layer 504 may have a thickness of about 0.05 micrometers. Each one of top layer 502, spacer layer 504, and bottom layer 506 may be composed of any suitable material (e.g., plastic, such as polyethylene terephthalate ("PET") polymer sheets, etc.). For example, each one of top layer 502, spacer layer 504, and bottom layer 506 may be composed of PET polymer sheets that may each have a thickness in the range of about 0.025 millimeters to about 0.1 millimeters.

Top layer 502 may couple to or include a corresponding conductive pad 508, and bottom layer 506 may couple to or include a corresponding conductive pad 510. Conductive pad 508 may include conductive traces (not shown) on an underside of top layer 502, and conductive pad 510 may include conductive traces (not shown) on an upper side of bottom layer 506. Conductive pads 508 and 510 and the conductive traces may be composed of any suitable material (e.g., metal, such as silver or copper, etc.).

As shown in FIG. 5, spacer layer 504 may include voids 514 that may allow top layer 502 to contact bottom layer 506 when, for example, elastomeric dome 100 buckles and roof portion 106 moves in the negative Y-direction (e.g., due to external force A on key cap 200). In particular, voids 514 may allow conductive pad 508 physical access to conductive pad 510 such that their corresponding conductive traces may make contact with one another. This contact may then be detected by a processing unit (e.g., a chip of the electronic device or keyboard), which may generate a code corresponding to key cap 200.

Although FIG. 5 shows a specific layered membrane that may be used to trigger a switch event, it should be appreciated that other mechanisms may also be used to trigger the switch event. For example, in some embodiments, nub 107 of elastomeric dome 100 may be conductive or may include a conductive material. In these embodiments, a separate conductive material may also reside beneath nub 107. When a keystroke occurs (e.g., when external force A is applied to key cap 200), the nub 107 (or the conductive material of nub 107) may contact the separate conductive material, which may trigger the switch event.

Figure 6:
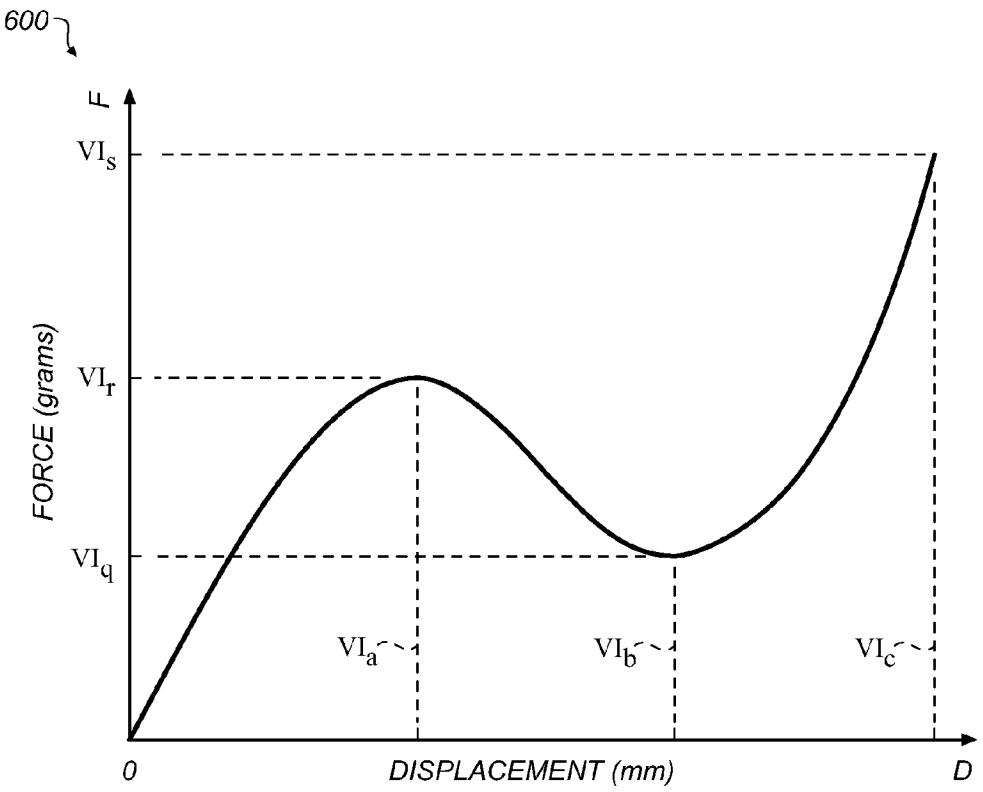
FIG. 6 shows a predefined force-displacement curve according to which the key cap of FIG. 3 and the elastomeric dome of FIG. 2 may operate, in accordance with at least one embodiment.

Operating characteristics of a dome-switch key can be defined using a force-displacement curve. FIG. 6 shows a predefined force-displacement curve 600 according to which the combination of key cap 200 and elastomeric dome 100 may operate. The F-axis may represent the force (in grams) that is applied to key cap 200, and the D-axis may represent the displacement of key cap 200 in response to the applied force.

The force required to depress key cap 200 from its natural position 220 (e.g., the position of key cap 200 prior to any force being applied thereto, as shown in FIG. 2) to a maximum displacement position 250 (e.g., as shown in FIG. 2) may vary. As shown in FIG. 6, for example, the force required to displace key cap 200 may gradually increase as key cap 200 displaces in the negative Y-direction from natural position 220 (e.g., 0 millimeters) to a position 230 (e.g., VIa millimeters). This gradual increase in required force is at least partially due to the resistance of elastomeric dome 100 to change shape (e.g., the resistance of roof portion 106 to displace in the negative Y-direction). The force required to displace key cap 200 to position 230 may be referred to as the operating or peak force.

When key cap 200 displaces to position 230 (e.g., VIa millimeters), elastomeric dome 100 may no longer be able to resist the pressure, and wall 102 may begin to buckle. The force that is subsequently required to displace key cap 200 from position 230 (e.g., VIa millimeters) to a position 240 (e.g., VIb millimeters) may gradually decrease.

When key cap 200 displaces to position 240 (e.g., VIb millimeters), contact surface 107 of elastomeric 100 may contact membrane 500 to cause or trigger a switch event or operation. In some embodiments, contact surface 107 may contact membrane 500 slightly prior to or slightly after key cap 200 displaces to position 240. When contact surface 107 contacts membrane 500, membrane 500 may provide a counter force in the positive Y-direction, which may increase the force required to continue to displace key cap 200 beyond position 240. The force required to displace key cap 200 to position 240 may be referred to as the draw or return force.

When key cap 200 displaces to position 240, elastomeric dome 100 may also be complete in its buckling. In some embodiments, roof portion 106 may continue to displace in the negative Y-direction, but the wall of elastomeric dome 100 may be substantially buckled. The force that is subsequently required to displace key cap 200 from position 240 (e.g., VIb millimeters) to position 250 (e.g., VIc millimeters) may gradually increase. Position 250 may be the maximum displacement position of key cap 200 (e.g., a bottom-out position). When the force (e.g., external force A) is removed from key cap 200, elastomeric dome 100 may then unbuckle and return to its natural position, and key cap may also return to natural position 220.

In some embodiments, one or more portions that may protrude from underside 204 of key cap 200 may contact top surface 133 of lower portion 130. The size or height of these protruding portions may be defined to determine the maximum displacement position 250 or travel of key cap 200 in the negative Y-direction. For example, the travel of key cap 200 may be defined to be about 0.75 millimeter, 1.0 millimeter, or 1.25 millimeters.

To provide a predefined tactile feedback to the user pressing key cap 200, force VIr (required to displace key cap from natural position 220 to position 230) and force VIq (required to displace key cap 200 from position 230 to position 240) of elastomeric dome 100 may have a predefined relationship. In particular, the level of tactile feedback may be a function of the ratio (e.g., click ratio) of VIr to VIq. The click ratio may be calculated as: $[(VIr-VIq)/VIr]\times 100$. In some embodiments, for example, the predefined level of tactile feedback may be provided when the click ratio is set to 50%. For example, a click ratio that is lower than 50% may provide insufficient tactile feedback to a user (e.g., elastomeric dome 100 may be too soft or mushy). In contrast, a click ratio that is higher than 50% may provide too much tactile feedback, making it difficult for the user to depress key cap 200 (e.g., elastomeric dome 100 may be too stiff or hard).

It should be appreciated that a variety of factors may affect the ability of elastomeric dome 100 to operate according to force-displacement curve 600. For example, any one of the physical characteristics (e.g., size, shape, material composition characteristics (e.g., hardness, elasticity, etc.), and the like) of elastomeric dome 100 may be defined such that elastomeric dome 100 may operate according to force-displacement curve 600.

Moreover, in making an electronic device smaller or thinner (and thus decreasing the travel of the keys of the keyboard), physical dimensions of an elastomeric dome may be further defined based on spacing requirements.

For example, in some embodiments, the travel of key cap 200 may be defined to be at most 1.25 millimeters. In these embodiments, for example, lower portion 130 of elastomeric dome 100 may have a thickness that is less than a predefined thickness. As another example, height h1 of elastomeric dome 100 may be less than a predefined height. For example, height h1 may be less than or equal to 2.10 millimeters. In this example, contact distance c1 between contact surface 107 of roof portion 106 and a plane that is parallel to bottom surface 134 of elastomeric dome 100 may also be less than a predefined contact distance. For example, contact distance c1 may be less than or equal to 0.82 millimeters. It should be appreciated that the smaller the height of elastomeric dome 100, the less roof portion 106 may displace prior to contacting membrane 500. As yet another example, diameter d1 (e.g., the outer diameter of the footprint) of elastomeric dome 100 may be less than a predefined diameter. For example, outer diameter d1 may be less than or equal to 6.00 millimeters.

The aforementioned lower portion thickness, dome height, roof portion and membrane contact distance, and outer diameter may, for example, allow the elastomeric dome 100 to conform to strict spacing requirements within an electronic device or keyboard housing, and meet a predefined travel (e.g., 1.25 millimeters) of key cap 200. In some embodiments, these defined parameters may also allow elastomeric dome 100 to operate according to predetermined force-displacement curve 600 (and thus, provide a specified tactile feedback). In some embodiments, other features of elastomeric dome 100 may also be specifically defined. In particular, an angle between wall 102 and a plane that is parallel to bottom surface 134 of elastomeric dome 100 may be less than a predefined angle. For example, angle θ1 between wall portion 102 and the plane that is parallel to bottom surface 134 may be less than or equal to a predefined angle (e.g., 50 degrees).

Additionally, thickness 103 wall 102 of elastomeric dome 100 may be less than a predefined thickness. For example, thickness 103 may be about equal to one another, and may be less than or equal to 0.24 millimeters. In this manner, elastomeric dome 100 may begin to buckle when key cap 200 displaces a predefined distance (e.g., VIa millimeters), and may also provide a predetermined click ratio (e.g., 50%).

Moreover, the hardness of the material of elastomeric dome 100 may be greater than a predefined hardness such that thinner a wall may not buckle as easily (e.g., such that the wall of elastomeric dome 100 does not buckle prior to key cap 200 reaching position 230). In this manner, elastomeric dome 100 may operate according to force-displacement curve 600.

In some embodiments, a width or diameter of roof portion 106 may be greater than a predetermined diameter. For example, diameter r1 of roof portion 106 may be greater than or equal to 3.17 millimeters. A wider roof portion may, for example, compensate for a weakened structural integrity of elastomeric dome 100 due to thinner wall portions.

In some embodiments, elastomeric dome 100 may be configured such that a ratio between thickness 103 (or thickness 105) and diameter r1 is less than or equal to a predetermined value (e.g., 10%). For example, the ratio between a thickness 103 of 0.24 millimeters and a diameter r1 of 3.17 millimeters may be calculated as: $(0.24/3.17)\times 100=7.57\%$. In some embodiments, elastomeric dome 100 may be configured such that a ratio between thickness 103 and outer diameter d1 may be less than or equal to a predetermined value (e.g., 4%). For example, the ratio between a thickness 103 of 0.24 millimeters and an outer diameter d1 of 6 millimeters may be calculated as: $(0.24/6)\times 100=4\%$. In some embodiments, elastomeric dome 100 may be configured such that a ratio between thickness 103 and height h1 may be less than or equal to a predetermined value (e.g., 12%). For example, the ratio between a thickness 103 of 0.24 millimeters and a height h1 of 2.10 millimeters may be calculated as: $(0.24/2.10)\times 100=11.4\%$. For example, the ratio between a thickness 103 of 0.24 millimeters and a height h1 of 2.10 millimeters may be calculated as: $(0.24/2.10)\times 100=11.4\%$. Elastomeric dome 100 may be configured to have any of these ratios so as to operate according to force-displacement curve 600.

Thus, various physical characteristics of elastomeric dome 100 can be defined based on spacing requirements of an electronic device or keyboard housing, the travel of key cap 200 of a keyboard, and predefined force-displacement curve 600 to provide a low travel switch.

Figure 7:
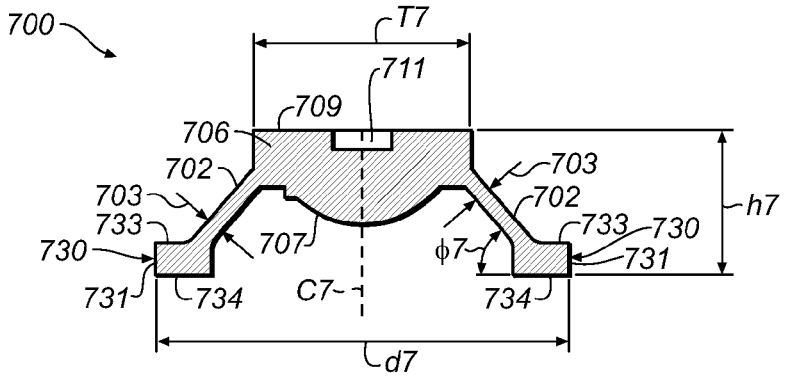
FIG. 7 is a cross-sectional view of another elastomeric dome, in accordance with at least one embodiment.

FIG. 7 is a cross-sectional view of an elastomeric dome 700. Elastomeric dome 700 is axis-symmetric, therefore the right and left halves of dome 700 are mirror images of each other. Dome 700 has footprint 730 defined by foot portion 731. Foot portion 731 is coupled to roof portion 706 by wall 702, which has thickness 703.

Roof portion 706 may include a contact surface 707, a top surface 709, and a recess 711 on to surface 709. A key cap (e.g., key cap 200) may reside over top surface 709 and recess 711. When an external force is applied (e.g., from the key cap 200) to any one of top surface 709 and recess 711, roof portion 706 may move in the negative Y-direction, and may cause wall 702 to change shape and buckle. As a result, contact surface 707 may contact a portion of a membrane of a keyboard (e.g., membrane 500) when roof portion 706 moves a sufficient distance in the negative Y-direction.

Similar to elastomeric dome 100, elastomeric dome 700 may be configured based on spacing requirements, as well as to provide a predefined travel (e.g., of keys of a keyboard). In some embodiments, elastomeric dome 700 may be configured to provide a predefined travel of at most 1.00 millimeters. In these embodiments, for example, height h2 of elastomeric dome 700 may be less than a predefined height. For example, height h2 may be less than or equal to 1.90 millimeters. In this example, contact distance c2 between the contact surface 707 of roof portion 706 and a plane that is parallel to bottom surface 734 of elastomeric dome 700 may also be less than a predefined contact distance. For example, contact distance c2 may be less than or equal to 0.63 millimeters. It should be appreciated that the smaller the height of elastomeric dome 700, the less roof portion 706 may displace prior to contacting a membrane (e.g., membrane 500). As yet another example, diameter d2 of elastomeric dome 700 (e.g., the outer diameter of the footprint) may be less than a predefined diameter. For example, outer diameter d2 may be less than or equal to 6.00 millimeters.

Similar to elastomeric dome 100, the aforementioned dome height, roof portion and membrane contact distance, and dome diameter may, for example, allow elastomeric dome 700 to conform to strict spacing requirements within an electronic device or keyboard housing, and may meet a predefined travel (e.g., 1.00 millimeters) of the keys of the keyboard. In some embodiments, these defined parameters may also allow the elastomeric dome to operate according to a predetermined force-displacement curve (and thus, provide a specified tactile feedback). In some embodiments, other features of elastomeric dome 700 may also be specifically defined. In particular, an angle between a wall portion (or contiguous wall) of elastomeric dome 700 and the plane that is parallel to bottom surface 734 of elastomeric dome 700 may be less than a predefined angle. For example, angle θ2 between wall 702 and the plane that is parallel to bottom surface 734 may be less than or equal to a predefined angle (e.g., 51 degrees).

Additionally, thickness 703 of wall 702 may be less than a predefined thickness. For example, thickness 703 may be about equal to one another, and may be less than or equal to 0.21 millimeters. In this manner, elastomeric dome 700 may begin to buckle when the roof portion 706 displaces a predefined distance, and may also provide a predetermined click ratio (e.g., 50%).

Moreover, the hardness of the material of elastomeric dome 700 (e.g., silicone) may be greater than a predefined hardness such that a thinner wall does not buckle as easily (e.g., such that wall 702 of elastomeric dome 700 does not buckle prior to key cap 200 reaching a position that may be similar to position 230).

In some embodiments, a width or diameter of the roof portion of elastomeric dome may 700 be greater than a predetermined diameter. For example, diameter r2 of roof portion 706 may be greater than or equal to 3.19 millimeters. A wider roof portion may, for example, compensate for a weakened structural integrity of elastomeric dome 700 due to thinner wall portions.

In some embodiments, elastomeric dome 700 may be configured such that a ratio between thickness 703 and diameter r2 is less than or equal to a predetermined value (e.g., 10%). For example, the ratio between a thickness 703 of 0.21 millimeters and a diameter r2 of 3.19 millimeters may be calculated as: (0.21/3.19)×100=6.58%. In some embodiments, elastomeric dome 700 may be configured such that a ratio between thickness 703 and outer diameter d2 may be less than or equal to a predetermined value (e.g., 4%). For example, the ratio between a thickness 703 of 0.21 millimeters and an outer diameter d2 of 6 millimeters may be calculated as: (0.21/6)×100 3.5%. In some embodiments, elastomeric dome 700 may be configured such that a ratio between thickness 703 and height h2 may be less than or equal to a predetermined value (e.g., 12%). For example, the ratio between a thickness 703 of 0.21 millimeters and a height h2 of 1.9 millimeters may be calculated as: (0.21/1.9)×100 11.05%. Elastomeric dome 700 may be configured to have any of these ratios in order that elastomeric dome 700 may operate according to a force-displacement curve that may be similar to force-displacement curve 600.

Thus, various physical characteristics of elastomeric dome 700 can be defined based on spacing requirements of an electronic device or keyboard housing, the travel of the keys of the keyboard, and a predefined force-displacement curve.

Figure 8:
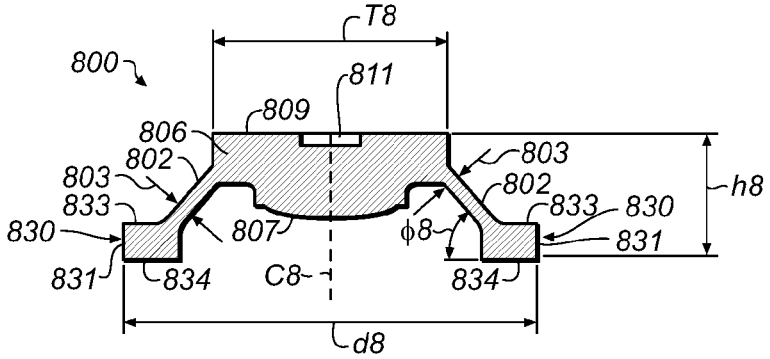
FIG. 8 is a cross-sectional view of yet another elastomeric dome, in accordance with at least one embodiment.

FIG. 8 is a cross-sectional view of elastomeric dome 800. Elastomeric dome 800 is axis-symmetric, therefore the right and left halves of dome 800 are mirror images of each other. Dome has footprint 830 defined by foot portion 831. Foot portion 831 is coupled to roof portion 806 by wall 802, which has thickness 803.

Roof portion 806 may include a contact surface 807, a top surface 809, and a recess 811 on to surface 809. A key cap (e.g., key cap 200) may reside over top surface 809 and recess 811. When an external force is applied (e.g., from the key cap 200) to any one of top surface 809 and recess 811, roof portion 806 may move in the negative Y-direction, and may cause wall portions 802 and 804 (and thus, a contiguous wall) to change shape and buckle. As a result, contact surface 807 may contact a portion of a membrane of a keyboard (e.g., membrane 500) when roof portion 806 moves a sufficient distance in the negative Y-direction.

Similar to elastomeric dome 100, elastomeric dome 800 may be configured based on spacing requirements, as well as to provide a predefined travel (e.g., of keys of a keyboard). In some embodiments, elastomeric dome 800 may be configured to provide a predefined travel of at most 0.75 millimeters. In these embodiments, for example, height h3 of elastomeric dome 800 may be less than a predefined height. For example, height h3 may be less than or equal to 1.70 millimeters. In this example, contact distance c3 between the contact surface 807 of roof portion 806 and a plane that is parallel to bottom surface 834 of elastomeric dome 800 may also be less than a predefined contact distance. For example, contact distance c3 may be less than or equal to 0.55 millimeters. It should be appreciated that the smaller the height of elastomeric dome 800, the less roof portion 806 may displace prior to contacting a membrane (e.g., membrane 500). As yet another example, diameter d3 of elastomeric dome 800 (e.g., the outer diameter of the footprint) may be less than a predefined diameter. For example, outer diameter d3 may be less than or equal to 5.60 millimeters.

Similar to elastomeric dome 100, the aforementioned dome height, roof portion and membrane contact distance, and dome diameter may, for example, allow elastomeric dome 800 to conform to strict spacing requirements within an electronic device or keyboard housing, and may meet a predefined travel (e.g., 1.00 millimeters) of the keys of the keyboard. In some embodiments, these defined parameters may also allow the elastomeric dome to operate according to a predetermined force-displacement curve (and thus, provide a specified tactile feedback). In some embodiments, other features of elastomeric dome 800 may also be specifically defined. In particular, an angle between a wall portion (and thus, a contiguous wall) of elastomeric dome 800 and the plane that is parallel to bottom surface 834 of elastomeric dome 800 may be less than a predefined angle. For example, angle θ3 between wall 802 and the plane that is parallel to bottom surface 834 may be less than or equal to a predefined angle (e.g., 51 degrees).

Additionally, thickness 803 may be less than a predefined thickness. For example, thicknesses 803 may be about equal to one another, and may be less than or equal to 0.19 millimeters. In this manner, elastomeric dome 800 may begin to buckle when the roof portion 806 displaces a predefined distance, and may also provide a predetermined click ratio (e.g., 50%).

Moreover, the hardness of the material of elastomeric dome 800 (e.g., silicone) may be greater than a predefined hardness such that a thinner wall may not buckle as easily (e.g., such that wall 802 does not buckle prior to key cap 200 reaching a position that may be similar to position 230).

In some embodiments, a width or diameter of the roof portion of elastomeric dome may 800 be greater than a predetermined diameter. For example, diameter r3 of roof portion 806 may be greater than or equal to 3.16 millimeters. A wider roof portion may, for example, compensate for a weakened structural integrity of elastomeric dome 800 due to thinner wall portions.

In some embodiments, elastomeric dome 800 may be configured such that a ratio between thickness 803 and diameter r3 is less than or equal to a predetermined value (e.g., 10%). For example, the ratio between a thickness 803 of 0.19 millimeters and a diameter r3 of 3.16 millimeters may be calculated as: (0.19/3.16)×100=6.01%. In some embodiments, elastomeric dome 800 may be configured such that a ratio between thickness 803 and outer diameter d3 may be less than or equal to a predetermined value (e.g., 4%). For example, the ratio between a thickness 803 of 0.19 millimeters and an outer diameter d3 of 5.6 millimeters may be calculated as: (0.19/5.6)×100 3.39%. In some embodiments, elastomeric dome 800 may be configured such that a ratio between thickness 803 and height h3 may be less than or equal to a predetermined value (e.g., 12%). For example, the ratio between a thickness 803 of 0.19 millimeters and a height h3 of 1.7 millimeters may be calculated as: (0.19/1.7)×100=11.2%. Elastomeric dome 800 may be configured to have any of these ratios in order that elastomeric dome 800 may operate according to a force-displacement curve that may be similar to force-displacement curve 600.

Thus, various physical characteristics of elastomeric dome 800 can be defined based on spacing requirements of an electronic device or keyboard housing, the travel of the keys of the keyboard, and a predefined force-displacement curve.

Figure 9:
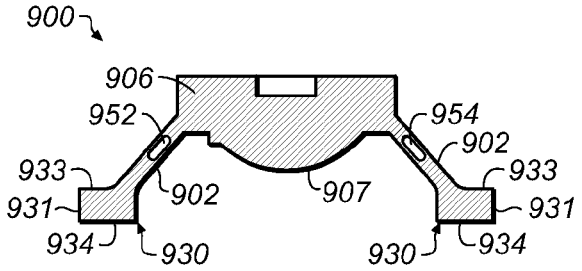
FIG. 9 is a cross-sectional view of an elastomeric dome including air pockets therethrough, in accordance with at least one embodiment.

FIG. 9 is a cross-sectional view of elastomeric dome 900 including a wall 902 having air pockets 952 and 954 incorporated therein. As shown in FIG. 9, elastomeric dome 900 may be similar to each one of elastomeric domes 100, 700, and 800, and include similar components such as wall 902, roof portion 906, and foot 931, which forms footprint 930

Air pockets 952 and 954 may have any suitable size and shape. In some embodiments, the size and shape of air pockets 952 and 954 may be defined based on a predefined key cap travel amount, and such that elastomeric dome 900 may operate according to a force-displacement curve that may be similar to force-displacement curve 600. In some embodiments, wall 902 may include any number of air pockets, even though only two are shown. In these embodiments, the size and shape of each one of these air pockets may be defined such that elastomeric dome 900 may operate according to a force-displacement curve that may be similar to force-displacement curve 600.

In making devices smaller (and thus decreasing the travel amount of keys), a thickness of a wall of a dome may also need to be made smaller. However, as described above, a thickness of a wall of a dome may be associated with the dome's ability to provide sufficient tactile feedback to a user upon depression of a corresponding key. For example, a thinner wall may buckle more easily, but may provide less tactile feedback, making it difficult for the dome to operate according to a predefined force-displacement curve. Thus, in some embodiments, a dome having multiple thin walls may be provided. The dome may be operative to buckle easily (e.g., according to a predefined force-displacement curve) over a predefined travel, while also providing sufficient tactile feedback to a user.

Figure 10:
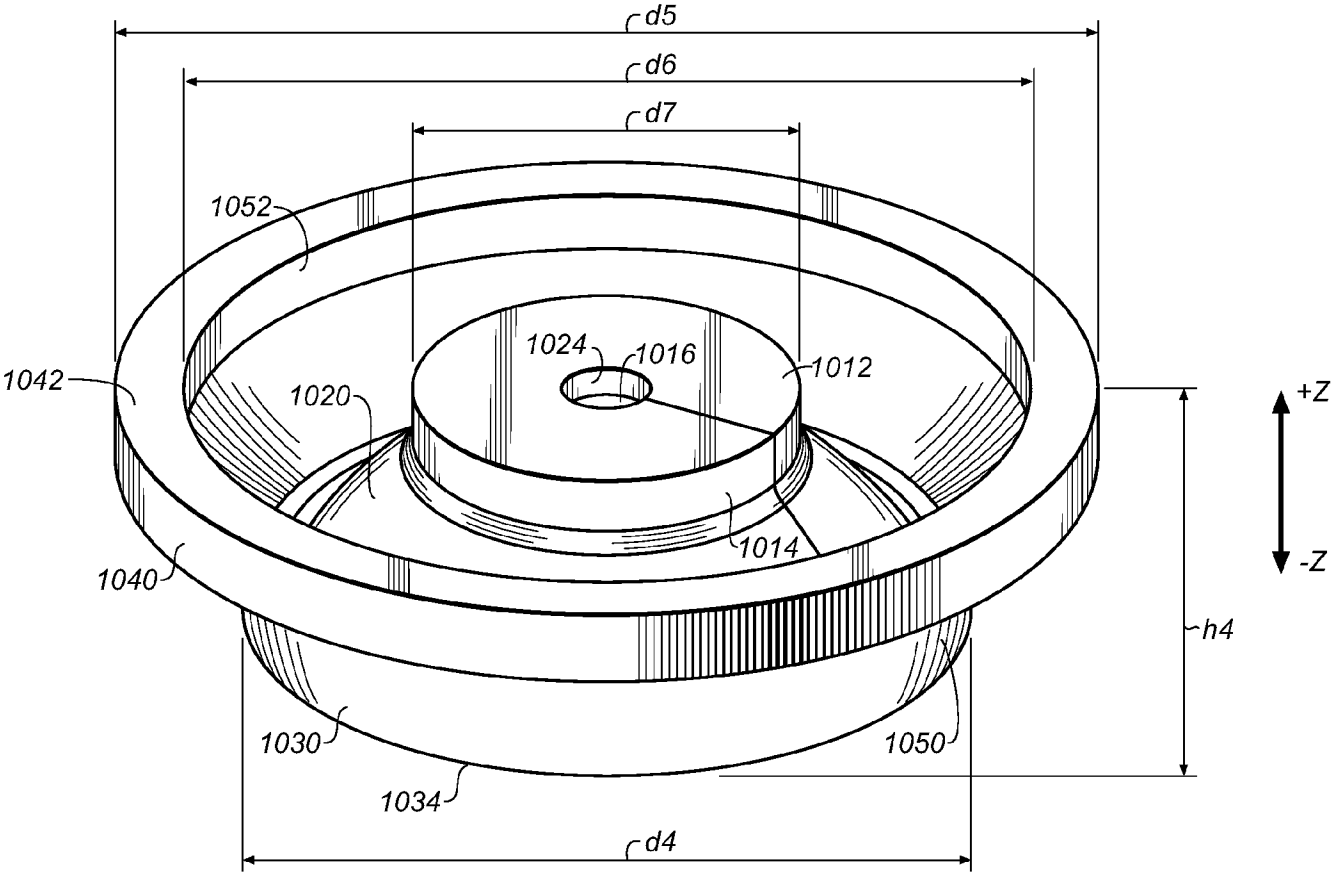
FIG. 10 is a perspective view of a double-wall dome, in accordance with at least one embodiment.
Figure 11:
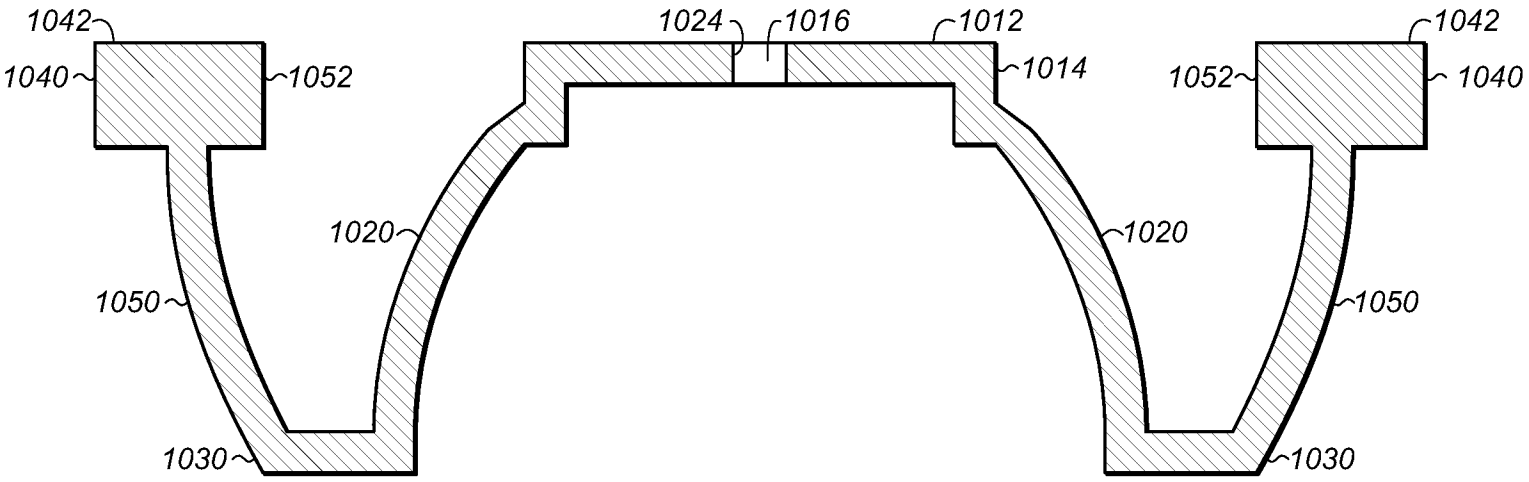
FIG. 11 is a cross-sectional view of the double-wall dome of FIG. 10, taken from a plane that extends in a Z-direction from the center of the doublewall dome, in accordance with at least one embodiment.

FIG. 10 is a perspective view of a double-wall dome 1000. FIG. 11 is a cross-sectional view of doublewall dome 1000, taken from a plane that extends in the Z-direction from the center of double-wall dome 100. Dome 1000 may be composed of any suitable material (e.g., similar to elastomeric dome 100), and may resemble a smaller dome in an up-right orientation disposed within or at least partially surrounded by a larger dome in an upside down orientation. In particular, dome 1000 may include a lower portion or footprint 1030, and upper rim portion 1040, and an outer hemi-spherical surface 1050 that may extend from lower portion 1030 to upper rim portion 1040. In addition, dome 1000 may include a roof portion 1010 and an inner hemi-spherical surface 1020 that may extend from lower portion 1030 to roof portion 1010. Roof portion 1010 may include a hole 1014 that may lead to a cavity or opening 1060 therein that may span from an inner side of lower portion 1030 to roof portion 1010, and that may face the −Z-direction. Dome 1000 may also include a cavity or opening 1052 that may span from lower portion 1030 to upper rim portion 1040, and that may face the positive Z-direction.

It can be appreciated that, if dome 1000 did not include inner-hemispherical surface 1020 and roof portion 1010, then dome 1000 would be an upside down dome including upper rim portion 1040, lower portion 1030, and outer-hemispherical surface 1050. Similarly, if dome 1000 did not include outer-hemispherical surface 1050 and upper rim portion 1040, then dome 1000 would be an upright dome including lower portion 1030, inner-hemispherical surface 1020, and roof portion 1010 (e.g., similar to elastomeric dome 100).

As described above, multiple thin walls may allow a dome to buckle easily (e.g., according to a predefined force-displacement curve) over a predefined travel, while also providing sufficient tactile feedback to a user. Thus, each one of inner and outer hemispherical surfaces 1020 and 1050 may have a predefined thickness. In some embodiments, inner and outer hemispherical surfaces 1020 and 1050 may have substantially the same thickness. In other embodiments, inner and outer hemi-spherical surfaces 1020 and 1050 may have different thicknesses.

As shown in FIG. 10, lower portion 1030 may have a diameter of d4, upper rim portion 1040 may have an outer diameter of d5 and an inner diameter of d6. Roof portion may have a diameter of d7 that may be smaller than any one of diameters d4, d5, and d6. Moreover, dome 1000 may have a predefined height h4 that may accommodate a shorter predefined travel amount. Similar to elastomeric domes 100, 700, and 800, any one of diameters d4-d7 and height h4 may also be tuned or predefined such that dome 1000 may operate according to a predefined force-displacement curve over a predefined travel, while also providing sufficient tactile feedback to a user.

In some embodiments, top surface 1012 of roof portion 1010 may be level or on the same plane as top surface 1042 of upper rim portion 1040. In these embodiments, one or more of top surfaces 1012 and 1042 may interface with a portion of a key cap (e.g., key cap 200) to receive a force in the −Z-direction (e.g., when key cap 200 is depressed by a user). Each one of inner and outer hemi-spherical surfaces 1020 and 1050 (e.g., tending to buckle more easily due to its smaller thickness) may receive the force from the key cap, and, in combination, may buckle according to a predefined force-displacement curve, while providing sufficient tactile feedback to a user. In other embodiments, top surface 1012 may be higher in the positive Z-direction than top surface 1042. In yet other embodiments, top surface 1042 may be higher in the positive Z-direction than top surface 1012.

While there have been described a low travel dome and systems for using the same, it is to be understood that many changes may be made therein without departing from the spirit and scope of the invention. Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. It is also to be understood that various directional and orientational terms such as "up" and "down," "front" and "back," "top" and "bottom," "left" and "right," "length" and "width," and the like are used herein only for convenience, and that no fixed or absolute directional or orientational limitations are intended by the use of these words. For example, the devices of this invention can have any desired orientation. If reoriented, different directional or orientational terms may need to be used in their description, but that will not alter their fundamental nature as within the scope and spirit of this invention. Moreover, an electronic device constructed in accordance with the principles of the invention may be of any suitable three-dimensional shape, including, but not limited to, a sphere, cone, octahedron, or combination thereof.

Therefore, those skilled in the art will appreciate that the invention can be practiced by other than the described embodiments, which are presented for purposes of illustration rather than of limitation.

We claim:

1. An elastomeric dome for use with a key, the elastomeric dome comprising:
- a lower portion;
- an upper portion; and
- a wall that spans from the lower portion to the upper portion, each of the wall, the lower portion, and the upper portion comprising:
  - a physical property comprising one of a thickness or a diameter, and the elastomeric dome being tuned to provide predefined tactile feedback over a predetermined travel amount of the key based on a predefined ratio between one of the physical properties and another one of the physical properties.

2. The elastomeric dome of claim 1, wherein the physical property of the wall is a wall thickness.

3. The elastomeric dome of claim 2, wherein the physical property of the lower portion is an outer diameter.

4. The elastomeric dome of claim 3, wherein the physical property of the upper portion is an upper diameter.

5. The elastomeric dome of claim 1, wherein the wall forms an angle with respect to the lower portion.

6. The elastomeric dome of claim 1, wherein the elastomeric dome is tuned to provide the predefined tactile feedback over the predetermined travel amount based on a predefined ratio between the angle and another one of the physical properties.

7. The elastomeric dome of claim 1, wherein the predefined tactile feedback is determined from a predefined force-displacement curve characteristic.

8. An elastomeric dome for use with a key in a keyboard, the elastomeric dome comprising:
- a footprint;
- a roof portion having a predetermined diameter; and
- a wall of a predetermined thickness that connects the roof portion to the footprint wherein;
  - a ratio between the predetermined thickness and the predetermined diameter is less than 0.10; and
  - the elastomeric dome is operative to enable a keystroke of the key to undergo an abrupt force change when the keystroke is 1.25 millimeters or less.

9. The elastomeric dome of claim 8, wherein a hollow cavity exist within an internal surface of the wall.

10. The elastomeric dome of claim 8 further comprising:
- a nub disposed opposite the roof portion.

11. The elastomeric dome of claim 8, wherein the predetermined thickness is in a range from 0.19 millimeters to 0.24 millimeters.

12. The elastomeric dome of claim 8, wherein the predetermined diameter is in a range from 3.16 millimeters to 3.19 millimeters.

13. The elastomeric dome of claim 8, wherein the footprint comprises an outer diameter that is greater than the predetermined diameter.

14. The elastomeric dome of claim 13, wherein the outer diameter is in a range from 5.6 millimeters to 6 millimeters.

15. The elastomeric dome of claim 8, wherein:
- the footprint is operative to reside over a planar surface; and
- the wall is disposed at a predetermined angle from the planar surface.

16. The elastomeric dome of claim 15, wherein the predetermined angle is one of 50 degrees and 51 degrees.

17. The elastomeric dome of claim 16, wherein the elastomeric dome comprises material having a predefined durometer.

18. The elastomeric dome of claim 8, wherein the abrupt force change provides a predefined tactile feedback to a user when the user depresses the key.

19. The elastomeric dome of claim 8, wherein the abrupt force change is based on a peak force and a draw force associated with the elastomeric dome.

20. A switch assembly comprising:

a key cap; and a hemispherical structure residing beneath the key cap and comprising:

an upper portion;

a lower portion having an outer diameter; and a domed surface extending from the upper portion to the lower portion, the domed surface having a predefined thickness; wherein:

a ratio between the predetermined thickness and the outer diameter is less than or equal to 0.04; and the hemispherical structure is operative control movement of the key cap according to a predetermined force-displacement curve characteristic when the movement is less than a predetermined amount.

21. The switch assembly of claim 20, wherein the predetermined amount is one of less than and equal to 1.25 millimeters.

22. The switch assembly of claim 20, wherein the domed surface comprises a predefined height from the lower portion to the upper portion.

23. The switch assembly of claim 22, wherein a ratio between the predetermined thickness and the predefined height is one of less than and equal to 0.12.

24. The switch assembly of claim 20, wherein the predefined force-displacement curve characteristic comprises a variation in a force required to move the upper portion over a range of predefined distances.

25. The switch assembly of claim 20, wherein the predefined force-displacement curve characteristic comprises a variation in a force required to move the key cap over a range of predefined distances.

26. The switch assembly of claim 20, wherein the hemispherical structure comprises material having a predefined durometer.

27. An apparatus for use with a key of a keyboard, the apparatus comprising:

an inner dome at least partially defining a top surface of the apparatus; and an outer dome at least surrounding the inner dome; wherein:

the inner dome defines a first opening that faces a first direction opposite the top surface; and the outer dome defines a second opening that faces a direction opposite the first direction.

28. The apparatus of claim 27, wherein the inner dome and the outer dome share a common footprint.

29. The apparatus of claim 28, wherein the inner dome comprises a roof portion and an inner hemispherical surface that extends from the roof portion to the footprint.

30. The apparatus of claim 29, wherein a diameter of the roof portion is less than a diameter of the footprint.

31. The apparatus of claim 28, wherein the outer dome comprises an upper rim portion and an outer hemispherical surface that extends from the upper rim portion to the footprint.

32. The apparatus of claim 31, wherein a diameter of the upper rim portion is greater than a diameter of the footprint.

33. The apparatus of claim 27, wherein the first direction is opposite a direction of a keystroke of the key.

34. The apparatus of claim 27, wherein a thickness of the inner dome is the same as the thickness of the outer dome.

35. The apparatus of claim 27, wherein a combination of the inner dome and the outer dome is operative to provide predefined tactile feedback in response to a keystroke of the key.

36. The apparatus of claim 27, wherein a combination of the inner dome and the outer dome is operative to operate according to a predefined force-displacement curve characteristic.

* * * * *